US010213637B1

(12) United States Patent
Soofer

(10) Patent No.: US 10,213,637 B1
(45) Date of Patent: Feb. 26, 2019

(54) WEARABLE AND DETACHABLE EXERCISE ACCESSORY

(71) Applicant: Mona Soofer, Los Angeles, CA (US)

(72) Inventor: Mona Soofer, Los Angeles, CA (US)

( * ) Notice: Subject to any disclaimer, the term of this patent is extended or adjusted under 35 U.S.C. 154(b) by 0 days.

(21) Appl. No.: 16/014,823

(22) Filed: Jun. 21, 2018

Related U.S. Application Data

(63) Continuation of application No. 15/994,311, filed on May 31, 2018.

(60) Provisional application No. 62/639,203, filed on Mar. 6, 2018.

(51) Int. Cl.

| | |
|---|---|
| ***A63B 21/055*** | (2006.01) |
| ***A63B 21/02*** | (2006.01) |
| *A63B 23/02* | (2006.01) |
| *A63B 23/04* | (2006.01) |
| *A63B 23/12* | (2006.01) |
| *A63B 21/04* | (2006.01) |

(52) U.S. Cl.
CPC ..... *A63B 21/0557* (2013.01); *A63B 21/028* (2013.01); *A63B 21/055* (2013.01); *A63B 21/0555* (2013.01); *A63B 21/02* (2013.01); *A63B 21/04* (2013.01); *A63B 21/0442* (2013.01); *A63B 23/0205* (2013.01); *A63B 23/0233* (2013.01); *A63B 23/04* (2013.01); *A63B 23/12* (2013.01); *A63B 2208/0204* (2013.01); *A63B 2208/0233* (2013.01)

(58) Field of Classification Search
CPC ... A63B 21/028; A63B 21/04; A63B 21/0442; A63B 21/02; A63B 21/0557; A63B 21/055; A63B 21/0555; A63B 23/0205; A63B 23/12; A63B 23/0233; A63B 23/04; A63B 2208/0204; A63B 2208/0233
See application file for complete search history.

(56) References Cited

U.S. PATENT DOCUMENTS

| | | | | |
|---|---|---|---|---|
| 2,700,317 | A * | 1/1955 | Lilienfeld | B64D 17/00 124/90 |
| 5,205,803 | A * | 4/1993 | Zemitis | A63B 21/0552 482/121 |
| 5,250,803 | A * | 10/1993 | Christ | B65H 7/125 250/223 R |
| 7,503,883 | B2 * | 3/2009 | Madden | A63B 21/0004 482/121 |
| 7,628,743 | B1 * | 12/2009 | Flentye | A63B 21/0004 482/121 |
| 7,794,374 | B1 * | 9/2010 | Park | A63B 21/0004 482/122 |
| 2010/0216613 | A1 * | 8/2010 | Pacini | A63B 21/0552 482/122 |

(Continued)

*Primary Examiner* — Megan Anderson
(74) *Attorney, Agent, or Firm* — Knobbe, Martens, Olson & Bear, LLP

(57) ABSTRACT

A highly portable exercise device utilizing resistance bands is provided. The exercise device includes two ends, each end with a gripping component and latching mechanism. The latching mechanism comprising two magnets, wherein each magnet is secured to opposing ends of the device. A user can thereby hold one end of the exercise device in one hand and secure the other end of the device in either the other hand or against a surface. The user can move his or her body to create tension in the exercise device allowing the user to perform a plurality of different exercises by applying a force to intended muscles.

20 Claims, 4 Drawing Sheets

(56) References Cited

U.S. PATENT DOCUMENTS

| | | | | |
|---|---|---|---|---|
| 2014/0051558 | A1* | 2/2014 | Flentye | A63B 21/0552<br>482/139 |
| 2016/0157569 | A1* | 6/2016 | Ingimundarson | A45D 8/34<br>63/1.11 |
| 2016/0279458 | A1* | 9/2016 | Kung | A63B 21/0555 |

* cited by examiner

WEARABLE AND DETACHABLE EXERCISE ACCESSORY

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND OF THE INVENTIONS

Field of the Inventions

The present inventions are directed to exercise devices. For example, resistance band exercise devices that can be worn by a user when not in use and that can be used for a plurality of exercises by a user using only the user's body and/or a nearby surface.

Description of the Related Art

It has been customary to perform strength training in several ways, such as by using (1) machines, (2) free weights (for example, dumbbells), or (3) body weight. Each method has advantages and disadvantages that can encourage a combination of exercises to achieve a desired result.

With strength training, motivation and convenience are factors that influence the frequency and time spent exercising. Exercises that require a high amount of time to prepare for (e.g. setting up weights on a machine, or putting on special workout clothing or gear), or a relatively large area of physical space (e.g. a treadmill), might be too difficult for a person to exercise very frequently. The difficulty in preparing for a workout can have a direct affect in the frequency of the workouts performed.

Thus, it is desirable to have a workout that requires only a minimal effort from the exerciser. For example, it would be desirable to have the convenience of body weight training with the effectiveness of using equipment with a high portability.

SUMMARY OF THE INVENTION

The disclosure herein provides methods, systems, and devices related to an exercise accessory. The embodiments disclosed herein can be configured to provide different exercise workouts for resistance training, stretching, strength training and stress relief. Some embodiments include a wearable and detachable exercise accessory that can be worn by a user (for example, wrapped around an ankle or wrist), or tied to a handbag, briefcase, or backpack. The two ends of the accessory can be connected together by a latch, clip, magnet, or the like. Some of the inventions can be used alone without the need to employ other types of equipment. Some embodiments can comprise grips at each end of the device allowing for a stable grip by a user of the exercise device.

Physical exercise is a recognized beneficial bodily activity that can be used for fitness, therapeutic purposes, and health purposes. The muscle fiber is the basic component that allows one to produce force. At the level of a single muscle cell, there is no difference between the resistance of gravity or inertia acting on a barbell or gravity's resistance on one's own body. To the solitary muscle fiber, resistance is resistance. Thus, resistance bands are a common type of resistance training, stretching, strength training and stress relief. In some embodiments of the exercise device, materials providing various resistance strengths can be used.

Exercise methods can be based on (1) machines, (2) free weights (for example, dumbbells), and/or (3) body weight. Each method has advantages and disadvantages that can encourage a combination of exercises to achieve a desired result. For example, machines are considered to be easy to learn and use, can isolate muscle groups more efficiently due to maintaining a stable posture while using the machines, and can allow for training with heavier weights without assistance. However, machines do not train complete human movement patterns and neglect smaller stabilizing muscles around joints, which can run the risk of chronic injury and poor posture. Free weights, for example, allow training functional movements such as movements typically done in daily activities allow a full range of motion, place greater demand on stabilizing muscles than machines. However, free weights take some skill to learn proper techniques, run the risk of injury if done improperly, and require the use of a spotter to list heavy weights in some circumstances. Body weight, for example, is the most convenient way to exercise as no equipment is needed, and similar to free weights, training can mimic movements typically done in daily activities and allow a full range of motion by primarily using natural body weight.

The manner in which exercises are made more difficult is the chief difference between training with weights and with one's own body weight. A person can simply add more weights to a bar to increase the difficulty of a bench press. Also, a person can increase the repetitions, but after a certain point body weight resistance produces more of an endurance exercise than a muscle-building one. A person can increase the range of motion by doing such moves as dive-bomber push-ups, and a person can increase distance traveled, as in clapping and jumping push-ups. A person can perform pushups one-handed, forcing the entire load onto one arm. A person can even learn planche push-ups, where the person's entire bodyweight is supported by hands and legs that are held horizontally above the ground.

An aspect of at least one of the inventions disclosed herein includes the realization that training with a wearable and easily portable hand-held resistance device provides the convenience of always being available, benefits of weight training, benefits of body weight training, and can be used in a confined space. The device can provide a user the opportunity to work out more frequently with less set up time and with the exercises taking up less physical space.

Thus, in some embodiments, an embodiment of a hand-held exercise device comprises an elongate body comprising at least three strands of one or more elastic materials, wherein the one or more elastic materials has a spring constant in Hooke's Law of between 5 N/m to 15 N/m; a first end and a second end, wherein each end comprises: a first gripping component on the first end and a second gripping component on the second end, both comprising the same materials as the elongate body such that a holding the gripping components would be comfortable to a human user, wherein the length between the centroid of the first gripping component to the centroid of the second gripping component as measured along the longitudinal axis of the elongate body is one of five inches to ten inches or eleven inches to twenty-one inches such that a human user can perform exercises with the device comfortably and wrap the device once or twice around their arm, respectively; one or more free ends comprising the same materials as the elongate body such that wearing the device would be comfortable to a human user when in contact with the human user's skin; and a latching mechanism comprising a first magnet and a second magnet, wherein the first magnet is configured to be detachably connected to the second magnet, the first magnet is secured to the one or more free ends on the first end and is secured at least half an inch from the first gripping component, the second magnet is secured to the one or more free ends on the second end and is secured at least half an inch from the second gripping component, the first and second magnet comprise a smaller physical volume than the gripping component such that the first and second magnets are not obstructing a human user from holding the two gripping components in the human user's hand or one gripping component in one hand and the other against at least one flat surface, the length between the first magnet and second magnet as measured along the longitudinal axis of the elongate body is one of six inches to eleven inches or twelve inches to twenty-two inches such that a human user can wrap the device around the human user's arm either one time or two times, respectively, and connect the two latching mechanisms together, wherein the device has a Young's modulus of between 3.5×104 N/m2 to 1.4×105 N/m2.

BRIEF DESCRIPTION OF THE DRAWINGS

These and other features and advantages of the inventions will become more apparent upon reading the following detailed description and with reference to the accompanying drawings of an embodiment that exemplifies the invention, in which.

DETAILED DESCRIPTION OF THE EMBODIMENTS

An improved exercise device is disclosed herein. The exercise device includes an improved structure which provides adequate resistance strength for strength training while stretched and is configured to be worn when not in use as a convenience and motivational instrument.

In some embodiments, the device can be manufactured using latex resistance bands as an exemplary material. However, it should be appreciated by a person of ordinary skill in the art that other materials, such as rubbers, plastics, composites, or the like can be used either alone or in combination. The device allows for a user to exercise various muscles in the body, which can include: muscles in the arm (such as biceps, brachioradialis, extensor carpi radialis longus, deltoids, triceps, and others), muscles in the chest (such as pectoralis minor and major, derratus anterior, and others), muscles in the back (such as rhomboids, trapezius, and others), muscles in the leg (for example, hamstrings, adductors, quadriceps, gastrocnemius, soleus, tobialis anterior, and others), and core muscles like the abdomen. Other muscles can be worked out depending on the multiple ways of holding the device and the various configurations as described herein. In some embodiments, the devices can be manufactured with varying elasticity or resistance strength as well as length such that difference exercises can be performed to work out muscles in difference parts of the body and to a degree that is desired by a user of the device.

Figure 1A:
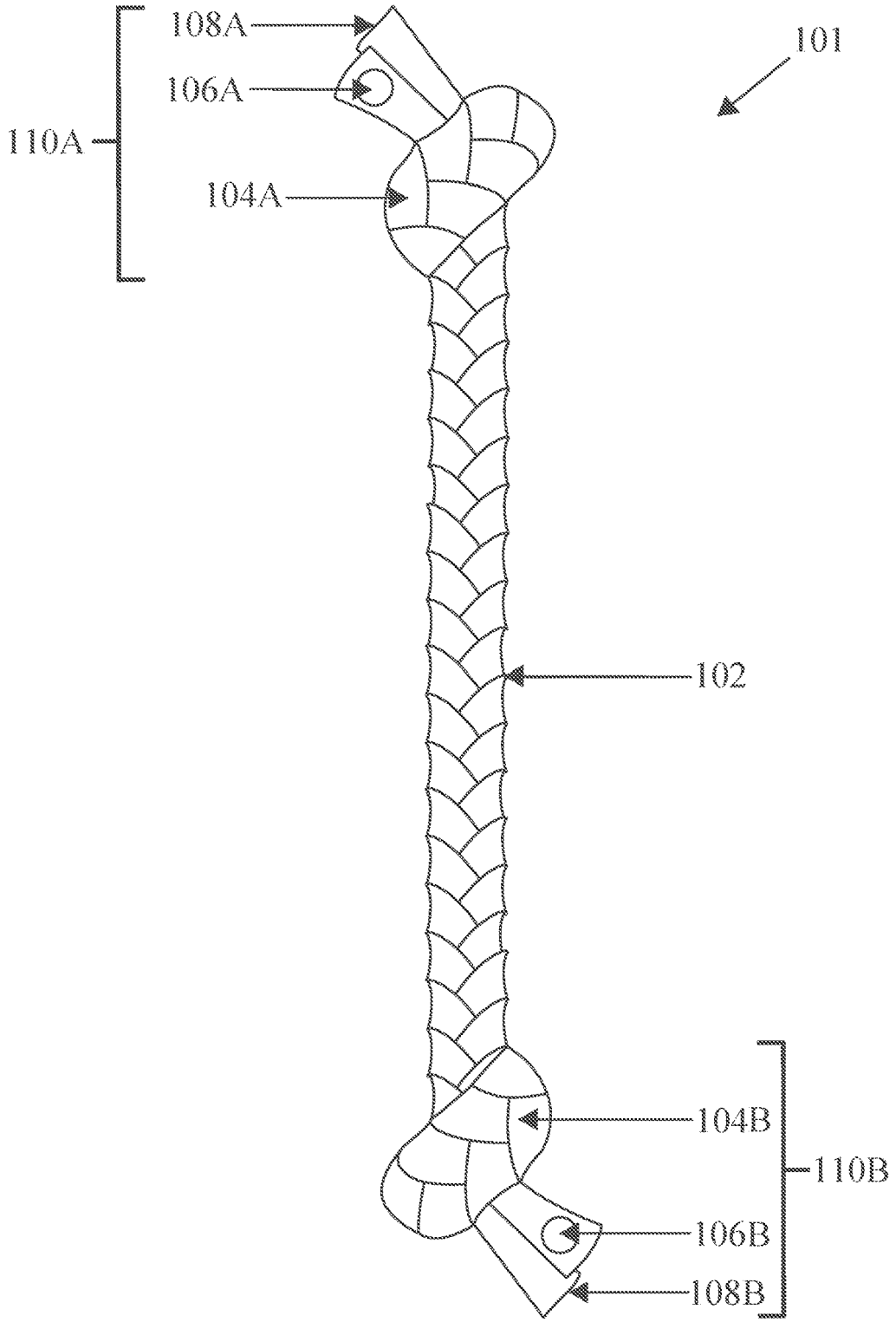
FIG. 1A is a front view of an embodiment of an exercise device in a relaxed state with ends that are disconnected from each other.

In some embodiments, the device can be manufactured with varying elasticity, or magnitudes of resistance strength. For example, resistance strengths can include a light, medium, and heavy configuration, among others. The device structure can be modified to match the resistance strength needed by a user of the device within a certain threshold tolerance. Also, the device can be manufactured with varying lengths. In some cases, different materials can be used to achieve the correct elasticity. In other cases, a different structure can be used (for example, braiding multiple portions of one material together as shown in FIG. 1A and described in more detail below) to achieve the same elasticity. Even in other cases, a combination of different materials and device structures can be used to meet the desired elasticity and length of the device, as well as any other particular needs of the user. For example, a user can desire to have a very short length device manufactured with a heavy configuration for the resistance strength. This can be achieved by using a less elastic material cut to the appropriate length, or the same material but wrapped or braided together with 1 or more strands of the material, for example, FIG. 1A depicts a braided configuration of two strands of a latex material. It should be appreciated that any number of strands can be braided with various techniques (for example, a one-strand braid, a two-strand braid, a three-strand braid, a four-string braid, or more). Also, braiding can be performed in various patterns, such patterns can comprise regular braiding as depicted in FIG. 1A, kumihimo (for example, round, half round, hollow, square, spiural, seven cord, or others), box, loop, or others. Additionally, each strand can comprise a varying width and varying elasticity or resistance. For example, a braid of three strands can comprise two strands of "light" resistance" and one strand of "medium" resistance" in the exercise device. It should be appreciated that any combination of resistances and widths can be used in the exercise device.

In some embodiments, the device can comprise of three strands of latex, intertwined, or braided, to form a uniform and interlaced strip which, in some embodiments, can be tied into a knot at each end. The braided configuration of the device is advantageous because it allows for greater durability and strength of the material as well as providing a unique and aesthetically pleasing design. The grip provides both grip and design for the product. The grip is used throughout the exercise as a grip handle in order for the user to easily hold the product while performing exercises. For example, a user can hold a grip where the grip is resting on the web of the user's hand between the thumb and index finger in the palm of the user's hand. As a user may sweat or have slippery palms, the grips are configured to be held when friction between the user's palms and the device is lubricated by the sweat or for any other reason. It should be appreciated that the device can comprise one or more materials in various embodiments, such as: latex, rubber, foam, TPE (thermoplastic elastomer), cotton blends (e.g. cotton blends with rubber or polyester), or any mixtures or combinations of such materials or similar materials. For example, a device with a braid of three strands can comprise one strand comprising latex, another strand comprising TPE, and a third strand comprising a cotton-polyester blend. It should be further appreciated that varying combinations of materials into one device (e.g. by braiding them together) can be designed based at least partly on the material properties associated with each of the materials to be used in the device, as well as, in some cases, the properties of the resulting device. For example, it may be desired to have a device with the measured elasticity of the device to be within a certain range. There can be many combinations of varying materials, each with its own material properties, to be braided in such a way as to achieve the desired elasticity of the device. Further, in some embodiments, a human user may want to increase the resistance provided by only one device (e.g. device A) for a particular exercise, and can hold two devices (e.g. devices A and B) together to perform the particular exercise with the desired resistance. For example, multiple devices (e.g. devices A and B) with varying or similar elasticity can be connected by the magnets on the ends such that the elongate bodies are parallel to each other, and/or, for example, magnet A of device A can be connected to magnet B of device B, and magnet B of device A can be connected to magnet A of device B.

In some embodiments, the device ends can clasp together for storage or for safe-keeping by wrapping the device around an arm, leg, backpack, purse, or the like. In some embodiments, where latex is used in the exercise device, after tying the ends of the strands of the exercise device into knots (for example, one knot at each end), there can be excess material at the end of each knot. The excess material, which is described herein as a "free end," can be connected or secured to a latching mechanism or securing device. In some embodiments, the securing device can comprise a magnet, clasp, clamp, hook, buckle or the like. In some embodiments, the excess material on one end of the device can be configured to be tied to the other end of the device. Once the two ends are connected, the device can resemble a bracelet shaped accessory. It should be appreciated that the latching mechanism can be designed with a minimal strength such that the connection can withstand intermittent contact with surfaces (for example, being brushed against a wall) and still remain connected. Further the latching mechanism can be designed with a method of detachment such that a user can use an appropriate level or force or effort to detach the two ends. Also, while a user holds a grip on the web of the user's hand between the thumb and index finger in the palm of the user's hand, as described above, the end of the device would also be in the palm of the user's hand, and, in some embodiments, it is desirable for the device to have a securing device that is both small and not obtrusive. A user would not find a large or hard clasp or buckle comfortable to hold (e.g., in a hand or under a leg as illustrated in certain exercises below) with certain exercises. Thus, in some embodiments, the device does not comprise a securing device larger than the average diameter of the grip or harder than the device material.

In some embodiments, the device can advantageously be used in any place and at any time with a limited amount of space to work out. For example, unlike body weight exercises that require relatively large floor or wall space to work out, the device can be used while seated or standing without fully extending ones arms outward. Additionally, in some embodiments, the device can be configured to attach to wrists as a bracelet, keychains, travel and handbags, as well as other items. Due to the increased portability and small size of the product, users will be able to exercise anywhere, at any time, with the broad range of motions offered by body weight training but with the results of free weight or machine training.

With respect to the material characteristics, as an indicator of elasticity, Young's modulus can be used. Young's modulus can be represented in the following formula, where Y is Young's modulus, F is the force applied in Newtons to the solid, A is the cross-sectional area of the solid in meters squared, ΔL is the stretched length of the solid, and L0 is the original length of the solid. Thus, a solid with a greater value of Y will stretch less than a solid with a smaller Y, when the same force is applied.

$$Y = \frac{F/A}{\Delta L/L_0}$$

In some embodiments, the Young's modulus can range from $1\times10^4$ N/m$^2$ to $2\times10^5$ N/m$^2$. However, the Young's modulus in some embodiment can range from $3.5\times10^4$ N/m$^2$ to $1.4\times10^5$ N/m$^2$. It should be appreciated that the inventions as disclosed herein can also be designed with a Young's modulus that is lower than $1\times10^4$ N/m$^2$ or higher than $2\times10^5$ N/m$^2$ and still be used for its intended purposes. It should also be appreciated that the Young's modulus can also vary based on the desired resistance strength (i.e. elasticity) of the device. Some users may prefer a higher resistance device and/or a thicker device and both variations can affect the Young's modulus.

Additionally, an adapted form of Young's modulus can be used to measure the elasticity of elastic bands. This adapted form is known as Hooke's Law, which is classically applied to spring systems, but can also be used to describe the strength patterns observed in elastic bands for relatively small applied forces. The Hooke's Law formula follows, where F is the force applied to the elastic material in Newtons, k is the spring constant in Newtons per meter, and ΔL is the change in length of the elastic material in meters.

$$F=k\Delta L$$

To Estimate for k, the following equation can be used:

$$k = \frac{\mathrm{mg}}{\Delta L}$$

Although Hooke's law is a loose estimation for elastic devices, such as some of the embodiments disclosed herein, it can be used to estimate elasticity. The spring constants of the devices used in the Hooke's Law calculations disclosed herein can range from 20 N/m to 120 N/m. In some embodiments, the devices have spring constants in the ranges of 35 N/m to 110 N/m. It should be appreciated that some embodiments, as disclosed herein, can also be designed with a spring constant that is lower than 20 N/m, or a spring constant that is higher than 120 N/m, and the device can still be used for its intended purposes. It should also be appreciated that the spring constant in Hooke's Law can also vary based on the desired resistance strength (i.e. elasticity) of the device. Some users may prefer a higher resistance device and/or a thicker device and both variations can affect the Young's modulus.

Each of the strands in the exercise device, as described in more detail herein and in FIGS. 1 and 2, can include "free ends" 108A and 108B, and can be designed with varying elasticity or resistance. For example, the Hooke's Law spring constant for each strand can range from 5 N/m to 60 N/m. In some embodiments, for example, the spring constant in Hooke's Law can range between 5 N/m to 15 N/m for light rated strands; 15 N/m to 30 N/m for medium rated strands; and 30 N/m to 50 N/m for heavy rated strands. It should be appreciated that strands can have a spring constant in Hooke's Law that is lower than 5 N/m or higher than 50 N/m that are used in the exercise device. In some embodiments, the free ends 108A and 108B in FIGS. 1 and 2 can comprising the same materials as the elongate body 102 such that wearing the device would be comfortable to a human user when in contact with the human user's skin.

Figure 1B:
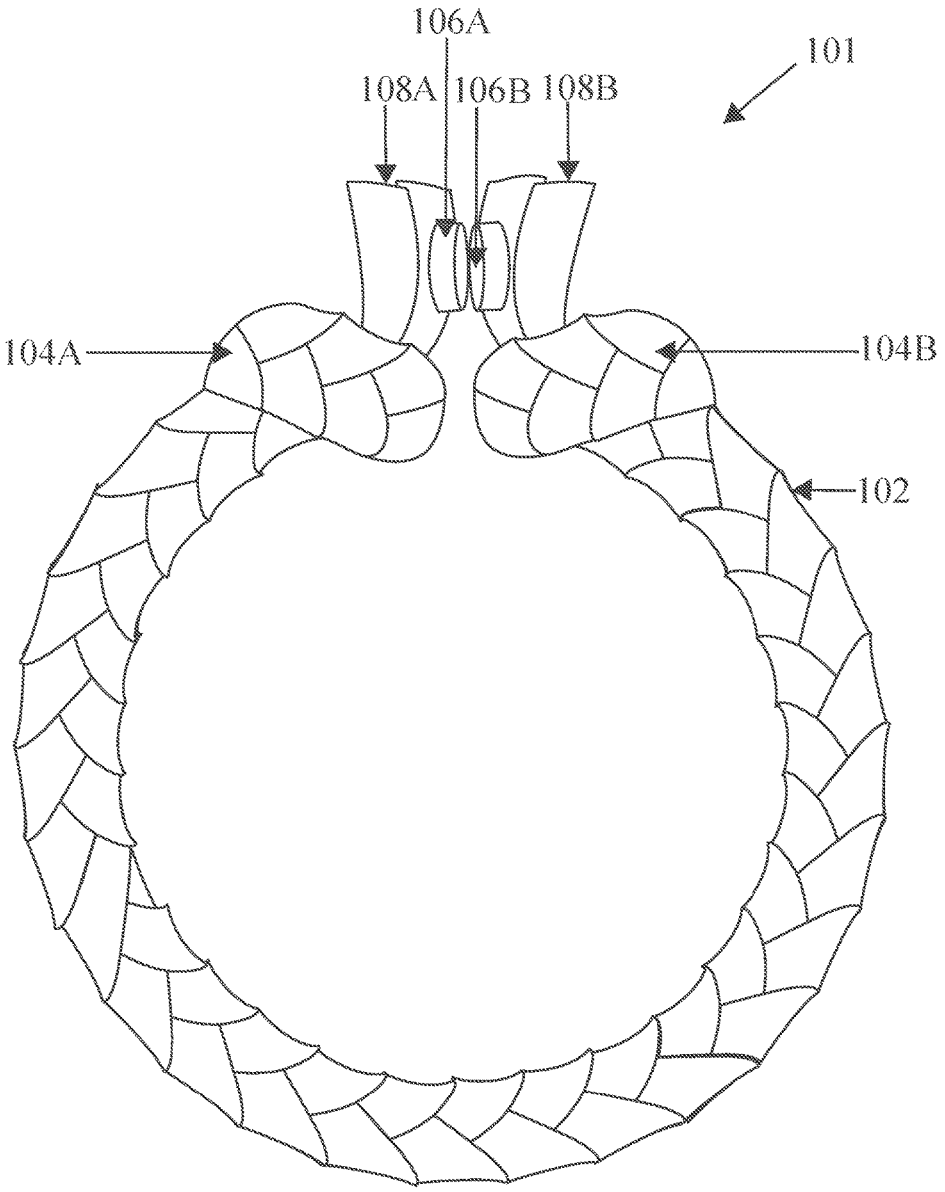
FIG. 1B is a front view of the exercise device shown in FIG. 1A that is in a relaxed state with ends connected with each other.

With reference to FIGS. 1 and 2, which depict an exemplary embodiment, the exercise device 101 comprises an elongate portion 102, two ends 110A and 110B. Each end comprises a gripping component or mechanism 104A and 104B, a latching mechanism or securing device 106A and 106B, and one or more free ends 108A and 108B. Specifically, FIG. 1A depicts the exercise device 101 in a resting position (i.e. not stretched) and straightened out. FIG. 1B depicts the same exercise device 101 at a resting position (i.e. not stretched) an instance prior to attaching the securing device 106A with securing device 106B, which in this instance are depicted as magnets. The gripping components 104A and 104B can comprise in some embodiments the same materials as the materials comprising the elongate body 102 such that a holding the gripping components would be comfortable to a human user. For example, in one configuration, a user may grip the exercise device at one gripping component 104A, for example, and will have a portion of the exercise device 101 in the curled portion of the user's fingers and hand (for example, a portion of the elongate body 102), and the edge of the gripping component 108A facing towards the elongate body 102 in contact with the user's edge of their curled fingers. The continuous contact with both the elongate body 102 and gripping component 104A may be more comfortable to some users if the material of both components of the exercise device were constructed of the same material to provide a less discontinuous textured feeling. Additionally, in some embodiments, the length between the centroid of one gripping component 104A, for example, to the centroid of a second gripping component 104B, for example, as measured along the longitudinal axis of the elongate body 102 can range from five inches to ten inches or eleven inches to twenty-one inches such that a human user can perform exercises with the device comfortably and wrap the exercise device around the user's arm once or twice, respectively.

Figure 2A:
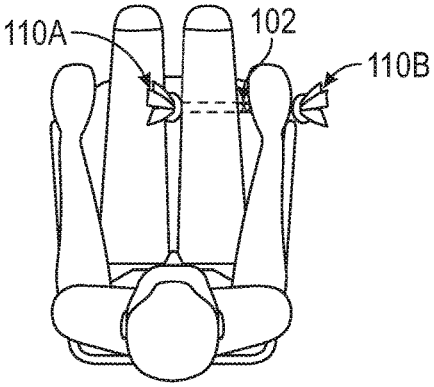
FIG. 2A is a top view of a person in a seated position holding an embodiment of the exercise device with a grip in one hand and positioning the other end between an inner thigh and a chair in preparation for an exercise, according to various embodiments.
Figure 2B:
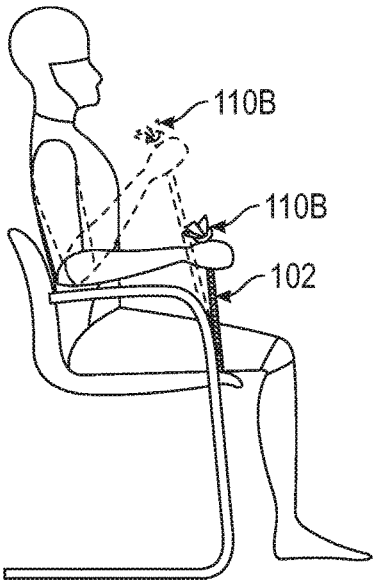
FIG. 2B is a side view of the person in FIG. 2A showing a range of motion the user can perform with the exercise device.

Optionally, the gripping components 104A and 104B can be created by tying the material into one or more knots. This can prevent a braided configuration from coming undone and also enable efficient and effective gripping of the device by a user. For example, a user can hold gripping component 104A with a right hand and gripping component 104B with a left hand and stretch the device apart across the user's chest, back, or head repetitively for a work out. Specifically, one arm can stay stationary while the other arm moves or both arms can move apart together, to focus on particular muscles. Additionally, if a user is seated, the gripping component 104A can be placed under the user's leg and held in place by the surface upon which the user is sitting and the user's leg, allowing the user to hold gripping component 104B in a hand and pull the end 110B away from 110A for resistance. For example, the user can do curls in a seated position. Also, a user can hold one of the gripping components 104A and 104B in each hand and wrap the elongate portion 102 around a foot and slowly extend the foot to increase resistance. Although some methods of exercise and use have been described, it should be appreciated that many other methods of use can be implemented by a user to work out many different muscles in the user's body. For example, any surface can be used to hold or secure one or both ends of the exercise device as shown in FIGS. 2A-2B and further described herein.

After tying the device's ends to form the gripping components 104A and 104B, there can be excess material 108A and 108B, respectively, at the end of each knot. The excess material 108A and 108B is described herein as a "free end." In some embodiments, the excess material on one end of the device 110A can be configured to be connected to the other end 110B of the device. In some embodiments, the excess material 108A and 108B can include a latching mechanism or securing device 106A and 106B. The securing devices 106A and 106B can comprise a magnet, clasp, clamp, or the like. FIGS. 1 and 2 depict a magnet as an exemplary embodiment for securing devices 106A and 106B.

Once the two ends 110A and 110B are attached, the device can resemble a bracelet shaped accessory. Thus, the device ends 110A and 110B can attach together for storage or for safe-keeping by wrapping the device around an arm, leg, backpack, purse, or the like. It should be appreciated that the latching mechanisms or securing devices 106A and 106B can be designed with a sufficient strength such that the connection can withstand intermittent contact or impacts with surfaces (for example, being brushed against a wall) and still remain connected. Further the latching mechanism or securing devices 106A and 106B can be designed with a method of detachment such that a user can use an appropriate level or force or effort to detach the two ends.

In some embodiments, the latching mechanisms can comprise a first magnet 106A and a second magnet 106B, wherein the first magnet 106A is configured to be detachably connected to the second magnet 106B. The first magnet 106A can be secured to the one or more free ends 108A on the first end 110A and optionally, secured at least half an inch from the first gripping component 104A at a point where the free end 108A connects to the gripping component 104A. The second magnet 106B can be secured to the one or more free ends 108B on the second end 110B and optionally, secured at least half an inch from the second gripping component 104B at a point where the free end 108B connects to the gripping component 104B.

In some embodiments, the first and second magnet 106A and 106B comprise a smaller physical volume than the gripping components 104A and 104B such that the first and second magnets 106A and 106B are not obstructing a human user from holding the two gripping components 104A and 104B in the human user's hand or one gripping component 104A, for example, in one hand and the other gripping component 104B, for example, against at least one flat surface. In some embodiments, the length between the first magnet 106A and the second magnet 106B as measured along the longitudinal axis of the elongate body 102 is six inches to eleven inches such that a human user can wrap the device around the human user's arm one time. In other embodiments, the length between the first magnet 106A and the second magnet 106B as measured along the longitudinal axis of the elongate body 102 is twelve inches to twenty-two inches or two times. Yet in other embodiments, the length between the first magnet 106A and the second magnet 106B as measured along the longitudinal axis of the elongate body 102 can be less than six inches, between six inches and eleven inches, between twelve and twenty-two inches, or more than twenty-two inches depending on how a human user chooses to store and/or use the device. For example, a user can wrap the exercise device 101 around the user's arm or wrist once (e.g., 5-10 inches), twice (e.g., 11-21 inches), three times, or more. In some embodiments, a user can wrap the exercise device 101 around a leg, waist, or other part of the body. In some embodiments, a user can wrap the exercise device 101 around a purse strap, backpack strap, or the like. Thus, the length of the exercise device 101 can vary based on what the object(s) the user intends to wrap the exercise device 101 around.

Figure 1C:
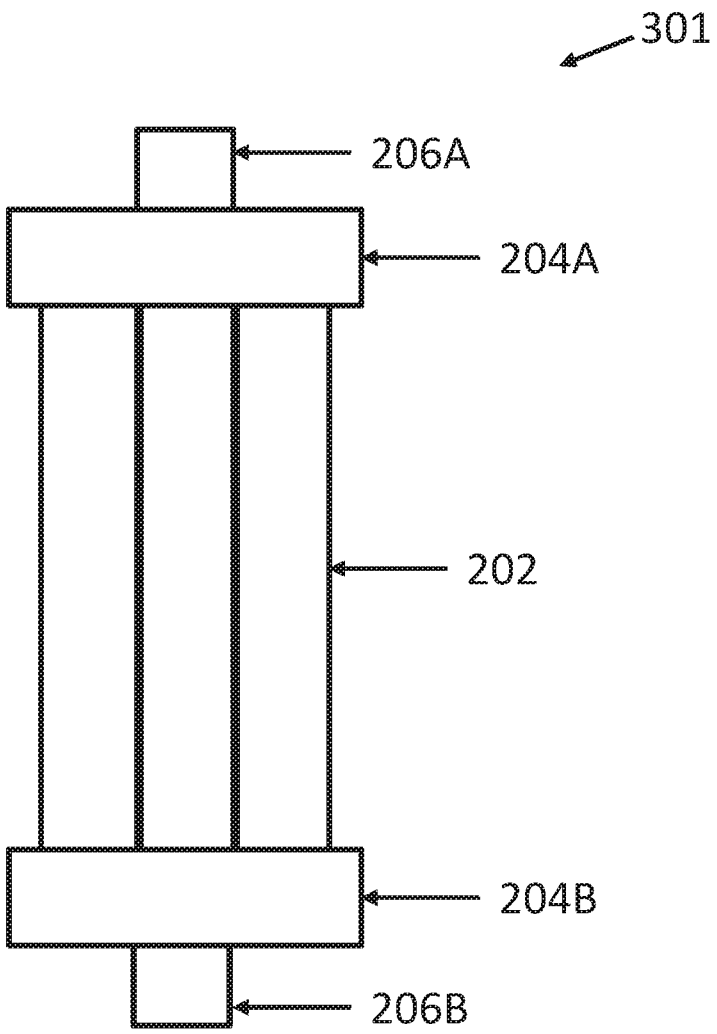
FIG. 1C is a schematic of a modification of the exercise device of FIGS. 1A and 1B having three strands.

FIG. 1C is a schematic diagram of an embodiment of a three-strand exercise device 301, which can comprise an elongate portion 202 similar to the elongate portion 102 in FIGS. 1 and 2. The embodiment in FIG. 1C can also include gripping components 204A and 204B, which can be similar to gripping components 104A and 104B. Such embodiments can also include latching mechanisms 206A and 206B, which are similar to latching mechanisms 106A and 106B. In some embodiments the three strands in the elongate portion 202 can be braided in various configurations as described herein. It should be appreciated that any number of strands can be braided with various techniques (for example, a one-strand braid, a two-strand braid, a three-strand braid, a four-string braid, or more). Also, braiding can be performed in various patterns, such patterns can comprise regular braiding as depicted in FIG. 1A, kumihimo (for example, round, half round, hollow, square, spiural, seven cord, or others), box, loop, or others. Additionally, each strand can comprise a varying width and varying elasticity or resistance. For example, a braid of three strands can comprise two strands of "light" resistance" and one strand of "medium" resistance" in the exercise device. It should be appreciated that any combination of resistances and widths can be used in the exercise device.

FIGS. 2A and 2B illustrate one potential exercise that can be performed with the exercise device 101. For example, FIG. 2A is a top view of a person in a seated position holding an exercise device 101 with one end 110B in one hand and positioning the other end 110A between an inner thigh and a chair in preparation for an exercise, according to various embodiments. The user can place the exercise device 101 under one of the user's legs and have the gripping component or mechanism (e.g., 104A and 104B from FIG. 1) touch the user's inner thigh to remain in place while the exercise is being performed. For example, in FIG. 2A, the user's right hand is holding one end 110B of the exercise device 101 and the other end 110A of the exercise device 101 is held in place by the user's the right leg, the chair, and the user's inner right thigh while in use during the exercise. The elongate body 102 of the exercise device 101 is illustrated in FIG. 2A with one end 110B secured in the user's right hand and the other end 110A anchored under the user's right leg. In some embodiments, the user can place the exercise device 101 underneath both legs so that the gripping component or mechanism on end 110A touches the user's outer thigh of the leg on the opposite side of the user's body from where the user is holding the other end 110B of the exercise device 101. In FIG. 2A, the location would be the outer thigh of the left leg.

FIG. 2B is a side view of the same person in FIG. 2A showing a range of motion the user can perform with the exercise device 101. A user can begin the exercise in a comfortable position with the user's elbow bent and arm parallel to the user's leg, where the exercise device 101 is not elongated and is at a resting state. The elongate body 102 is illustrated in the resting state in solid lines. The user can then curl the user's right arm, as shown in FIG. 2B, to a location close to the user's shoulder stretching the exercise device 101 beyond the exercise device's resting state so that the user must exert a force greater than the resistance of the exercise device 101 to move the user's arm to the desired location. This exercise can work out the user's bicep, for example. The elongate body 102 is illustrated in a stretched state in dashed lines. The end 110B moves from an initial position (e.g., shown in solid lines) to a final position (e.g., shown in dashed lines) as the user curls the user's right arm. In some modified exercises, the exercise device 101 can be longer or can be stretched to some degree when beginning the exercise. For example, if the user places the exercise device underneath both legs (not shown), the exercise device 101 may be in a relaxed state, for example, if it has a length of 11-21 inches or the exercise device 101 can have a shorter length of 5-10 inches and be stretched to some degree when the user begins the exercise. One of the material properties of the device is that the more the device is stretched, the more force is required to stretch the device further to a point of failure. So, a user may desire to increase resistance for the exercise by beginning the exercise where the exercise device 101 is already stretched to attain a higher resistance force for the exercise and improve the quality of the workout.

It will be understood that the exercise shown in FIGS. 2A and 2B can be performed by the left arm as well. For example, a user can hold one end 110A of the exercise device 101 in the user's left hand and place the other end 110B of the exercise device 101 underneath the user's left leg. The user can then curl the user's left arm to perform the exercise. This exercise would appear as a mirror image of FIG. 2A if it were to be illustrated.

Figure 3:
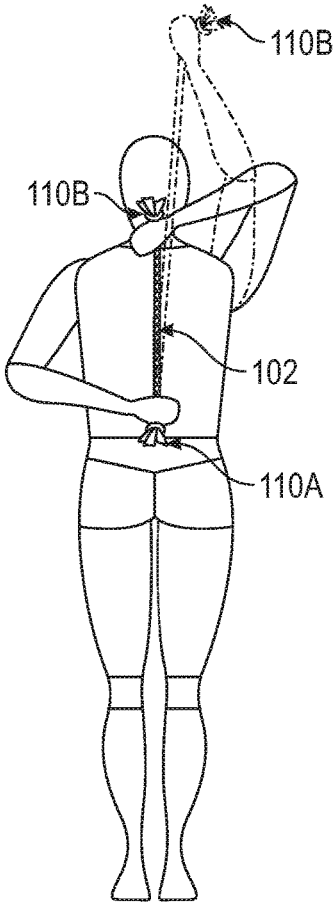
FIG. 3 is a rear view of a person in a standing position holding an exercise device with both hands showing a range of motion the user can perform with the exercise device, according to various embodiments.

FIG. 3 illustrates another potential exercise that can be performed with the exercise device 101. FIG. 3 is a rear view of a person in a standing position holding an exercise device 101 with a grip with both hands showing a range of motion the user can perform with the exercise device 101, according to various embodiments. The user can hold one end 110A of the exercise device 101 with the user's left hand behind the back and the other end 110B of the exercise device 101 with the user's right hand behind the user's head/neck. The user can then extend the user's right arm above the user's head to perform the exercise. The end 110B moves from an initial position to a final position as the user extends the user's right arm. The elongate body 102 is illustrated in a resting state, or initial position, in solid lines, and in a stretched state, or final position, in dashed lines.

It will be understood that the exercise shown in FIG. 3 can be performed by the left arm as well. For example, a user can hold one end 110A of the exercise device 101 in the user's left hand behind the user's head/neck and hold the other end 110B with the user's right hand behind the user's back. The user can then extend the user's left arm above the user's head to perform the exercise thereby stretching the elongate body 102. This exercise would appear as a mirror image of FIG. 2A if it were to be illustrated.

It will also be understood that in some embodiments, the length of the exercise device 101 can provide additional, optional benefits, for example but without limitation, some lengths of the exercise device 101 can allow a user to both wrap the device 101 once or twice around the user's arm and also perform a wide variety of exercises. It has been found that the length of 5-10 inches from the centroid of the first gripping component to the centroid of the second gripping component as measured along the longitudinal axis of the elongate body can provide the optional benefits of allowing some users having a typical arm diameter, to wrap the device 101 around their wrist once with its connection devices 106A, 106B connected to each other and also to perform certain convenient exercises such as the curling exercise illustrated in FIGS. 2A and 2B. Further, it has been found that the length of 11-21 can provide the optional benefits of allowing some users having a typical arm diameter, to wrap the device 101 around their wrist twice with the connection devices 106A, 106B connected to each other and also to perform certain convenient exercises such as the modified curling exercise described above and illustrated in FIGS. 2A and 2B. It will further be understood that the potential exercises described (e.g., in FIGS. 2A, 2B, and 3) are merely examples of exercises that can be performed. There exist many other exercises that a user can perform with the exercise device that are illustrated or described herein. A user can use one or both hands/arms, one or more surfaces, and/or one or more feet/legs to perform a variety of exercises. For example, in one exercise, a user can hold both ends of the exercise device in the user's hands and the user can bend the user's knees and wrap the device around the base of the user's feet. The user can then extend the user's feet while holding the two ends of the exercise device to achieve resistance and perform an exercise for both legs. In another example, a user can step on both ends of the exercise device using the floor to hold the device in place and the user can bend the user's knees while keeping the user's back straight to grab the elongate body with one or both hands and pull it up by extending the knees.

It will further be understood that the above-noted dimensions are merely exemplary. The dimensions each depend upon one another, upon the overall dimensions of the device and strands and the desired elasticity of the device or strands. It is understood that one of ordinary skill in the art can readily vary the dimensions to adapt the exercise device for a particular application through routine experimentation or use, in view of the disclosure herein.

Although the forgoing inventions have been described in terms of certain preferred embodiments, other embodiments will become apparent to those of ordinary skill in the art in view of the disclosure herein. Furthermore, the skilled artesian will recognize the interchangeability of various features of one modification of the winding board to another modification. Accordingly, the present inventions are not intended to be limited by the recitation of preferred embodiments, but are intended to be defined solely by the reference to the appended claims.

Conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without user input or prompting, whether these features, elements and/or steps are included or are to be performed in any particular embodiment. The headings used herein are for the convenience of the reader only and are not meant to limit the scope of the inventions or claims.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. Additionally, the skilled artisan will recognize that any of the above-described methods can be carried out using any appropriate apparatus. Further, the disclosure herein of any particular feature, aspect, method, property, characteristic, quality, attribute, element, or the like in connection with an embodiment can be used in all other embodiments set forth herein. For all of the embodiments described herein the steps of the methods need not be performed sequentially. Thus, it is intended that the scope of the present inventions herein disclosed should not be limited by the particular disclosed embodiments described above.

What is claimed is:

1. A hand-held exercise device comprising:

an elongate body comprising at least three strands of one or more elastic materials, wherein the at least three strands are braided together, and wherein the one or more elastic materials has a spring constant in Hooke's Law of between 5 N/m to 15 N/m; and a first end and a second end;

a first grip on the first end and a second grip on the second end, both of the first and second ends comprising the same materials as the elongate body, wherein a length between a centroid of the first grip to a centroid of the second grip as measured along a longitudinal axis of the elongate body without any measurable elongation of the hand-held exercise device is one of five inches to ten inches or eleven inches to twenty-one inches;

a first free end on the first end and a second free end on the second end comprising the same materials as the elongate body; and a latching mechanism comprising a first magnet and a second magnet, wherein the first magnet is configured to be detachably connected to the second magnet, the first magnet is secured to the first free end on the first end and is secured at a first distance that is at least half an inch from the first grip at a point where the first free end connects to the first grip, the second magnet is secured to the second free end on the second end and is secured at a second distance that is at least half an inch from the second grip at a point where the second free end connects to the second grip, the first and second magnet comprise a smaller physical volume than the first and the second grips such that the first and second magnets are not obstructing a human user from holding the first and the second grips in the human user's hand or the first grip in one hand and the second grip against at least one flat surface, a length between the first magnet and the second magnet, as measured along the longitudinal axis of the elongate body without any measurable elongation of the hand-held exercise device, is one of six inches to eleven inches or twelve inches to twenty-two inches, and the first and second magnets are further configured so that the human user is capable of engaging and disengaging the first and second magnets by applying a force with only one hand, wherein the hand-held exercise device has a Young's modulus of between $3.5\times10^4$ N/m$^2$ to $1.4\times10^5$ N/m$^2$.

2. The hand-held exercise device of claim 1, wherein each of the least three strands of the one or more elastic materials comprise the same length, diameter, and thickness.

3. The hand-held exercise device of claim 1, wherein each of the least three strands of the one or more elastic materials comprise the same spring constant in Hooke's Law.

4. The hand-held exercise device of claim 1, wherein the first grip and the second grip comprise the same physical volume.

5. The hand-held exercise device of claim 1, wherein the first distance and second distance are the same.

6. The hand-held exercise device of claim 1, wherein the first magnet and second magnet comprise the same shape and weight.

7. A hand-held exercise device comprising:

an elongate body comprising at least three strands of one or more elastic materials, wherein the at least three strands are braided together;

a first end and a second end;

a first grip on the first end and a second grip on the second end, both of the first and second ends comprising the same materials as the elongate body, wherein a length between a centroid of the first grip to a centroid of the second grip as measured along a longitudinal axis of the elongate body without any measurable elongation of the hand-held exercise device is one of five inches to ten inches or eleven inches to twenty-one inches;

a first free end on the first end and a second free end of the second end comprising the same materials as the elongate body; and a latching mechanism comprising a first magnet and a second magnet, wherein the first magnet is configured to be detachably connected to the second magnet, the first magnet is secured to the first free end on the first end and is secured at a first distance that is at least half an inch from the first grip at a point where the first free end connects to the first grip, the second magnet is secured to the second free end on the second end and is secured at a second distance that is at least half an inch from the second grip at a point where the second free end connects to the second grip, the first and second magnet comprise a smaller physical volume than the first and the second grips such that the first and second magnets are not obstructing a human user from holding the first and the second grips in the human user's hand or the first grip in one hand and the second grip against at least one flat surface, a length between the first magnet and the second magnet, as measured along the longitudinal axis of the elongate body without any measurable elongation of the hand-held exercise device, is one of six inches to eleven inches or twelve inches to twenty-two inches, and the first and second magnets are further configured so that the human user is capable of engaging and disengaging the first and second magnets by applying a force with only one hand.

8. The hand-held exercise device of claim 7, wherein the one or more elastic materials has a spring constant in Hooke's Law of between 5 N/m to 15 N/m.

9. The hand-held exercise device of claim 7, wherein the hand-held exercise device has a Young's modulus of between $3.5\times10^4$ N/m$^2$ to $1.4\times10^5$ N/m$^2$.

10. The hand-held exercise device of claim 7, wherein each of the least three strands of the one or more elastic materials comprise the same length, diameter, and thickness.

11. The hand-held exercise device of claim 7, wherein each of the least three strands of the one or more elastic materials comprise the same spring constant in Hooke's Law.

12. The hand-held exercise device of claim 7, wherein the first grip and the second grip comprise the same physical volume.

13. The hand-held exercise device of claim 7, wherein the first distance and second distance are the same.

14. The hand-held exercise device of claim 7, wherein the first magnet and second magnet comprise the same shape and weight.

15. A hand-held exercise device comprising:

an elongate body comprising at least three strands of one or more elastic materials, wherein the at least three strands are braided together;

a first end comprising:

a first grip comprising the same one or more elastic materials as the elongate body;

a first free end on the first end comprising the same materials as the elongate body;

a first latching mechanism comprising a first magnet, wherein the first magnet is secured to the first free end on the first end and is secured at least half an inch from the first grip at a point where the first free end connects to the first grip, and the first magnet comprising a smaller physical volume than the first grip such that the first magnet is not obstructing a human user from holding the first grip in the human user's hand or against a surface; and a second latching mechanism comprising a second magnet, wherein the second magnet is secured to a second free end on a second end of the elongated body and is secured at a second distance that is at least half an inch from a second grip at a point where the second free end connects to the second grip, and the second magnet is configured to be detachably connected to the first magnet and the first magnet is configured to be detachably connected to the second magnet.

16. The hand-held exercise device of claim 15, further comprising the second end comprising:

the second grip comprising the same one or more elastic materials as the elongate body, wherein a length between a centroid of the first grip to a centroid of the second grip as measured along a longitudinal axis of the elongate body without any measurable elongation of the hand-held exercise device is one of five inches to ten inches or eleven inches to twenty-one inches; and the second free end on the second end comprising the same materials as the elongate body wherein:

the second magnet comprising a smaller physical volume than the second grip such that the first and the second magnets are not obstructing the human user from holding the first and the second grips in the human user's hand or the first grip in one hand and the second grip against the flat surface, a length between the first magnet and the second magnet, as measured along the longitudinal axis of the elongate body without any measurable elongation of the hand-held exercise device, is one of six inches to eleven inches or twelve inches to twenty-two inches, and the first and the second magnets are further configured so that the human user can engage and disengage the first and second magnets by applying a force with only one hand.

17. The hand-held exercise device of claim 16, wherein each of the least three strands of the one or more elastic materials comprise the same length, diameter, and thickness.

18. The hand-held exercise device of claim 16, wherein the first grip and the second grip comprise the same physical volume.

19. The hand-held exercise device of claim 16, wherein the first distance and second distance are the same.

20. The hand-held exercise device of claim 16, wherein the first magnet and second magnet comprise the same shape and weight.

* * * * *